US005641321A

United States Patent [19]

Suzuki

[11] Patent Number: 5,641,321

[45] Date of Patent: Jun. 24, 1997

[54] ELONGATED CUTTING TOOL FOR WOOD WORKING AND APPARATUS FOR AND METHOD OF GRINDING THE SAME

[75] Inventor: Hiromi Suzuki, Ohbu, Japan

[73] Assignee: Kabushiki Kaisha Taihei Seisakusho, Komaki, Japan

[21] Appl. No.: 669,980

[22] Filed: Jun. 25, 1996

Related U.S. Application Data

[62] Division of Ser. No. 533,636, Sep. 25, 1995, which is a continuation of Ser. No. 73,705, Jun. 8, 1993, abandoned.

[30] Foreign Application Priority Data

Jun. 9, 1992 [JP] Japan ..... 4-176144

[51] Int. Cl.[6] ..... B24B 1/00

[52] U.S. Cl. ..... 451/45; 451/1; 451/19; 451/234; 451/262

[58] Field of Search ..... 451/234, 1, 5, 451/19, 124, 231, 190, 192, 195, 196, 262, 45

[56] References Cited

U.S. PATENT DOCUMENTS

| | | | |
|---|---|---|---|
| 2,566,112 | 8/1951 | Barnard | 30/357 |
| 3,292,478 | 12/1966 | Falk et al. | 83/679 |
| 3,299,925 | 1/1967 | McBrady et al. | 146/95 |
| 3,929,044 | 12/1975 | Beauchet | 82/46 A |
| 4,845,900 | 7/1989 | Suzuki et al. | 451/19 |
| 4,984,394 | 1/1991 | Suzuki et al. | 451/1 |
| 5,233,792 | 8/1993 | Suzuki | 451/234 |

*Primary Examiner*—Robert A. Rose
*Assistant Examiner*—George Nguyen
*Attorney, Agent, or Firm*—Lahive & Cockfield, LLP; W. Hugo Liepmann; Anthony A. Laurentano

[57] ABSTRACT

The invention provides a novel cutting tool used in wood working, which has a sufficiently thick cutting edge allowing stable cutting of a veneer from a log as well as an apparatus for and a method of grinding the cutting edge to have a favorable shape and a relatively large angle. The apparatus of the invention includes a table which an elongated cutting tool extending along a longitudinal axis of the table is mounted on, a fixing element for pressing the cutting tool upright against an upright plate, and a carriage which is reciprocatingly movable along the longitudinal axis of the table. The carriage is provided with a pair of grinding wheels which are respectively movable into and out of endwise grinding contact with an upper surface and a lower surface of the cutting edge of the upright cutting tool at desirable angles. The apparatus further includes a control mechanism for controlling a moving distance and an inclined angle of each grinding wheel according to a preset number of grinding steps and a predetermined grinding depth and a predetermined grinding angle at each grinding step for each surface of the cutting edge. The upper surface and the lower surface of the cutting edge are respectively multiple-taper ground to have an arc-shaped surface from the tip portion to the base portion of the cutting edge.

6 Claims, 17 Drawing Sheets

ELONGATED CUTTING TOOL FOR WOOD WORKING AND APPARATUS FOR AND METHOD OF GRINDING THE SAME

This application is a divisional application of Ser. No. 08/533,636 filed on Sep. 25, 1995, pending, which in turn is a continuation application of Ser. No. 08/073,705 filed on Jun. 8, 1993, abandoned. The contents of all of the aforementioned application(s) are hereby incorporated by reference.

BACKGROUND OF THE INVENTION

1. Field of the Invention

The present invention relates to an elongated cutting tool used in wood working devices such as veneer lathes and veneer slicers, and also to an apparatus for and a method of grinding such an elongated cutting tool.

2. Description of the Related Art

An elongated cutting tool 2 conventionally used for wood working has a sloping surface 'a' and a non-sloping surface 'b' as shown in FIG. 17, and a cutting edge thereof 2 has an acute angle as 20 through 30 degrees.

Such a conventional cutting tool generally has a thin and sharp cutting edge. When the thin cutting edge of the cutting tool hits against a knot or another hard portion of a log in the cutting process, an excessive load is applied onto the cutting edge. The cutting edge is thereby pressed back outwardly to separate from the log and then inwardly onto the log surface as a counteraction. The sharper cutting edge causes greater vibration of the cutting edge due to the press-back and press-on cycle. Such vibration results in the uneven thickness of a veneer cut from the log and undesirably damages the cutting edge hit against a knot, a resin pocket, or another hard portion of the log.

The applicant of the present invention has proposed an improved method of superfinishing a cutting edge, wherein the cutting edge of an elongated cutting tool is finished to have a curved surface by multiple-taper grinding as disclosed in JAPANESE PATENT LAYING-OPEN GAZETTE No. 63-99163. This method attains a thicker cutting edge with sufficient cutting quality.

The elongated cutting tool having a cutting edge superfinished according to the above method has greater angle and thickness than the conventional cutting tool to give longer service life. Improvement in the angle and thickness of the cutting edge is, however, not sufficient, which still causes unstable cutting or vibration of the cutting edge against the cut surface of the log.

In order to prevent vibration of the sharp cutting edge, a tip of a non-sloping surface of the cutting tool is ground off by a certain angle. Although this grinding procedure reduces the vibration of the cutting edge to some extent, the ground tip of the non-sloping surface slides against a rear side of a veneer currently cut from the log to damage or even crack the rear side of the veneer.

SUMMARY OF THE INVENTION

One object of the invention is to provide a novel cutting tool used in wood working, which has a sufficiently thick cutting edge allowing stable cutting of a veneer from a log.

Another object of the Invention is to provide an apparatus for and a method of grinding a cutting edge to have a favorable shape and a relatively large angle.

The above and other related objects are realized by an elongated cutting tool used in wood working, wherein a cutting edge thereof has an arc-shaped first surface and an arc-shaped second surface finished by multiple-taper grinding from a tip portion to a base portion of the respective surfaces.

An apparatus for grinding such a cutting tool includes a table which an elongated cutting tool extending along a longitudinal axis of the table is mounted on, a fixing element for pressing the cutting tool upright against an upright plate, and a carriage which is reciprocatingly movable along the longitudinal axis of the table. The carriage is provided with a pair of grinding wheels which are respectively movable into and out of endwise grinding contact with an upper surface and a lowersurface of the cutting edge of the upright cutting tool at desirable angles. The apparatus further includes a control mechanism for controlling a moving distance and an inclined angle of each grinding wheel according to a preset number of grinding steps and a predetermined grinding depth and a predetermined grinding angle at each grinding step for each surface of the cutting edge.

The invention also provides a method of multiple-taper grinding a first surface and a second surface of a cutting edge of such an elongated cutting tool with a pair of grinding wheels mounted on a carriage movable along a longitudinal axis of a table onto which the cutting tool extending along the longitudinal axis thereof is fixed upright. The first surface and the second surface of the cutting edge are multiple-taper ground according to desirable grinding angles and grinding depths set by a control circuit to have an arc shape, respectively.

The elongated cutting tool of the invention has a first surface and a second surface, which are multiple-taper ground from a tip to a base thereof to have an arc shape, respectively. This gives a sufficient thickness to the cutting edge. The apparatus of the invention allows relatively easy multiple-taper grinding with a control mechanism for controlling a moving distance and an inclined angle of each grinding wheel according to a preset number of grinding steps and a predetermined grinding depth and a predetermined grinding angle at each grinding step for each surface of the cutting edge.

These and other objects, features, aspects, and advantages of the present invention will become more apparent from the following detailed description of the preferred embodiment with the accompanying drawings.

DESCRIPTION OF THE PREFERRED EMBODIMENT

An apparatus for grinding an elongated cutting tool embodying the invention is first described in detail based on the drawings.

Figure 1:
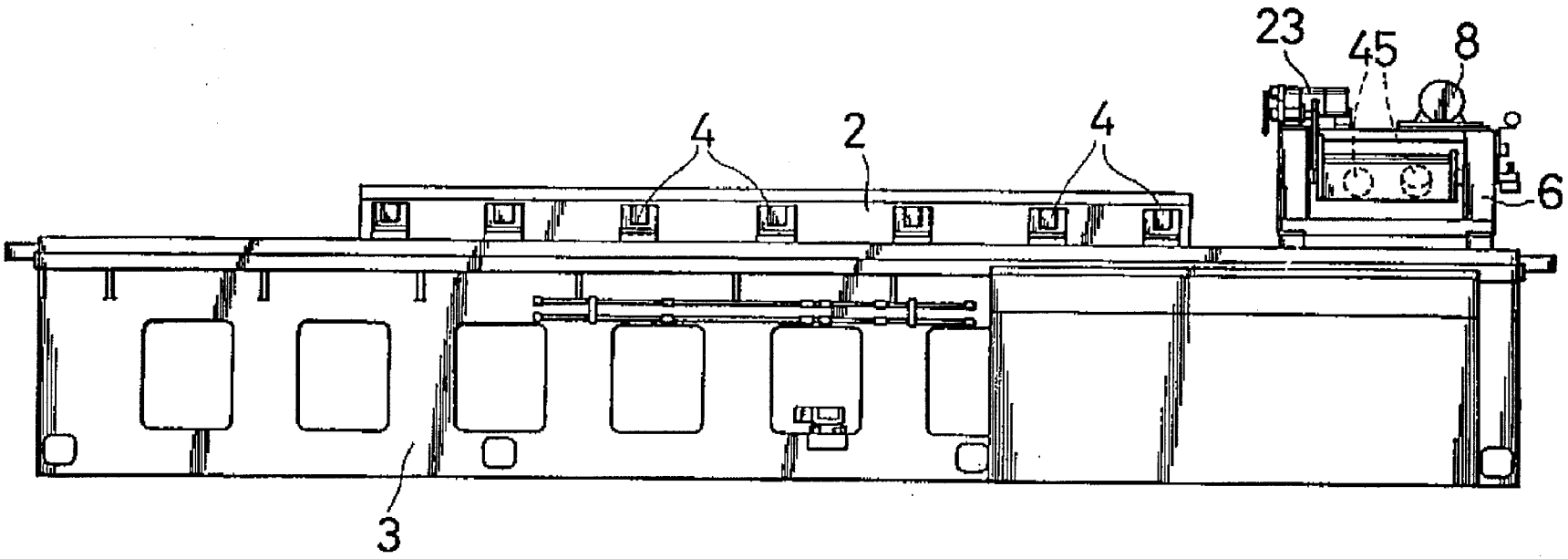
FIG. 1 is a front view illustrating a general structure of a grinding apparatus for grinding an elongated cutting tool as a preferred embodiment according to the invention.
Figure 2:
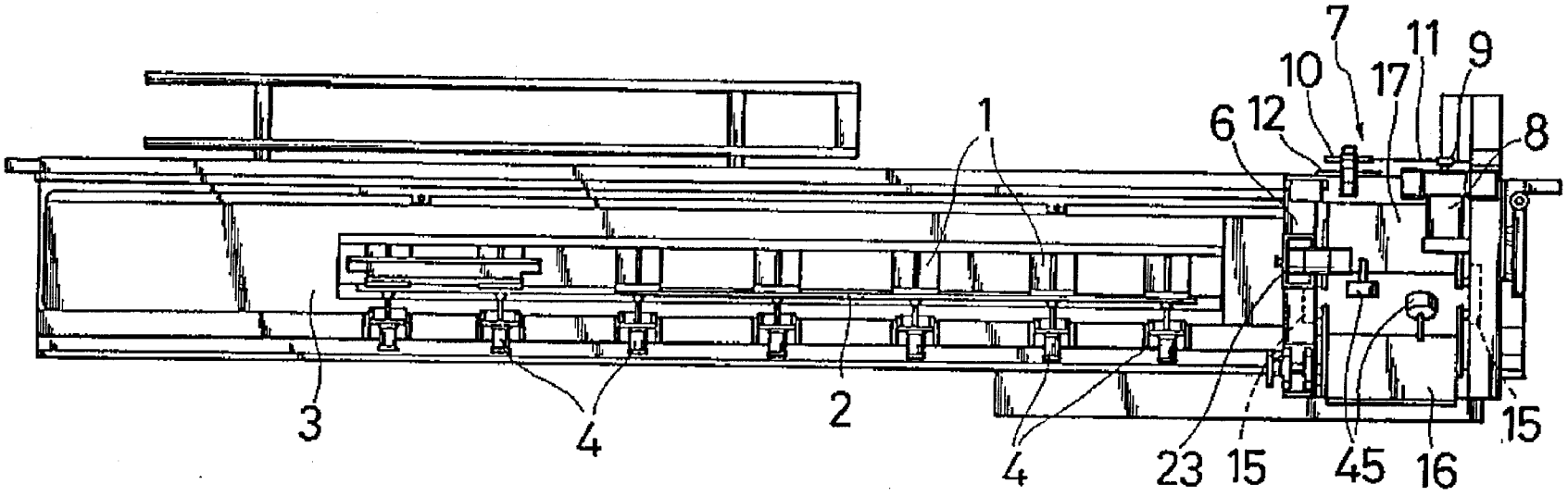
FIG. 2 is a plan view showing the grinding apparatus of FIG. 1.

FIG. 1 is a front view showing a general structure of a grinding apparatus of an embodiment; FIG. 2 is a plan view of the grinding apparatus; and FIG. 3 and FIG. 4 are a side view and a rear view showing part of the grinding apparatus, respectively.

Figure 3:
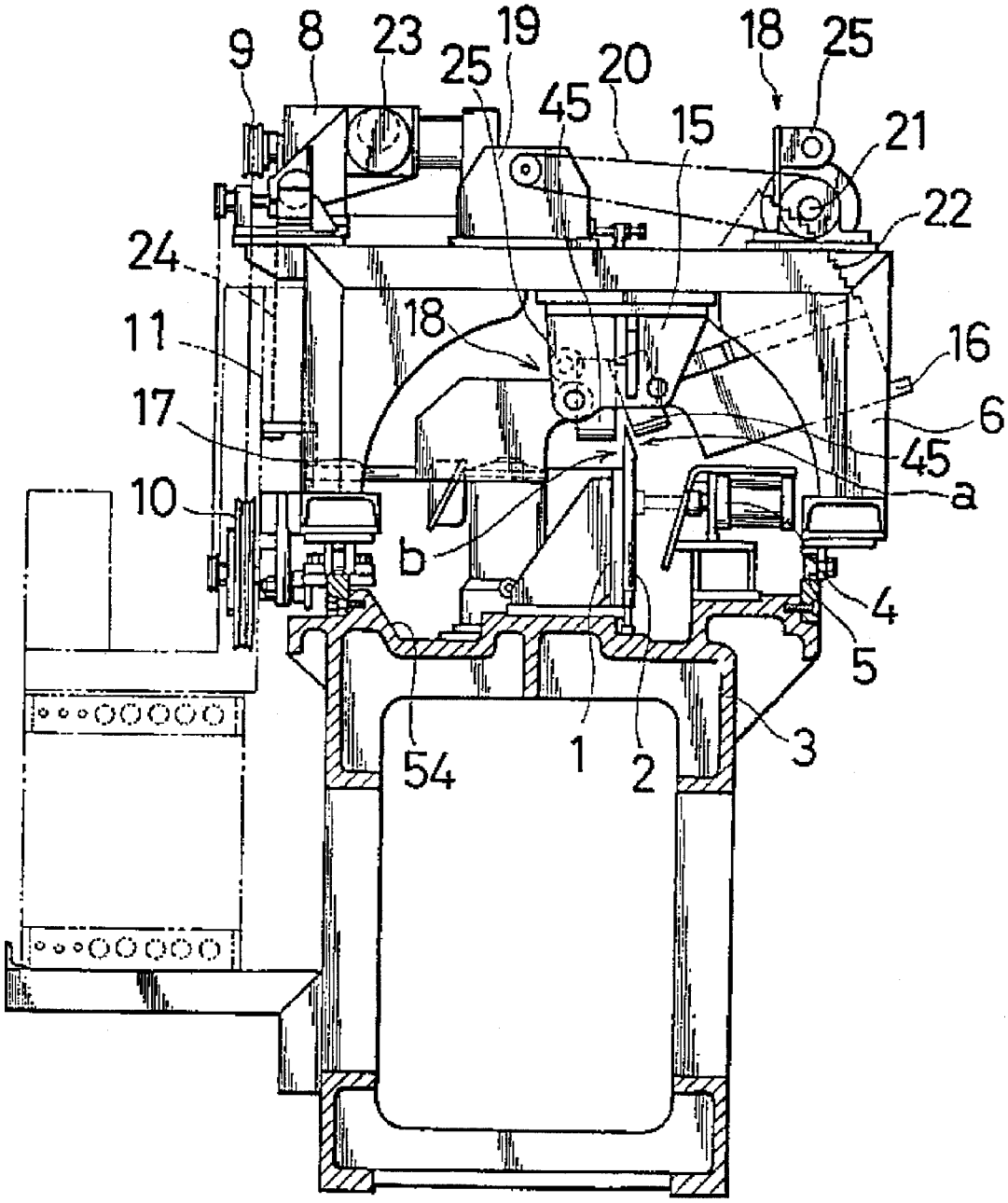
FIG. 3 is a side view illustrating part of the grinding apparatus of FIG. 1.
Figure 4:
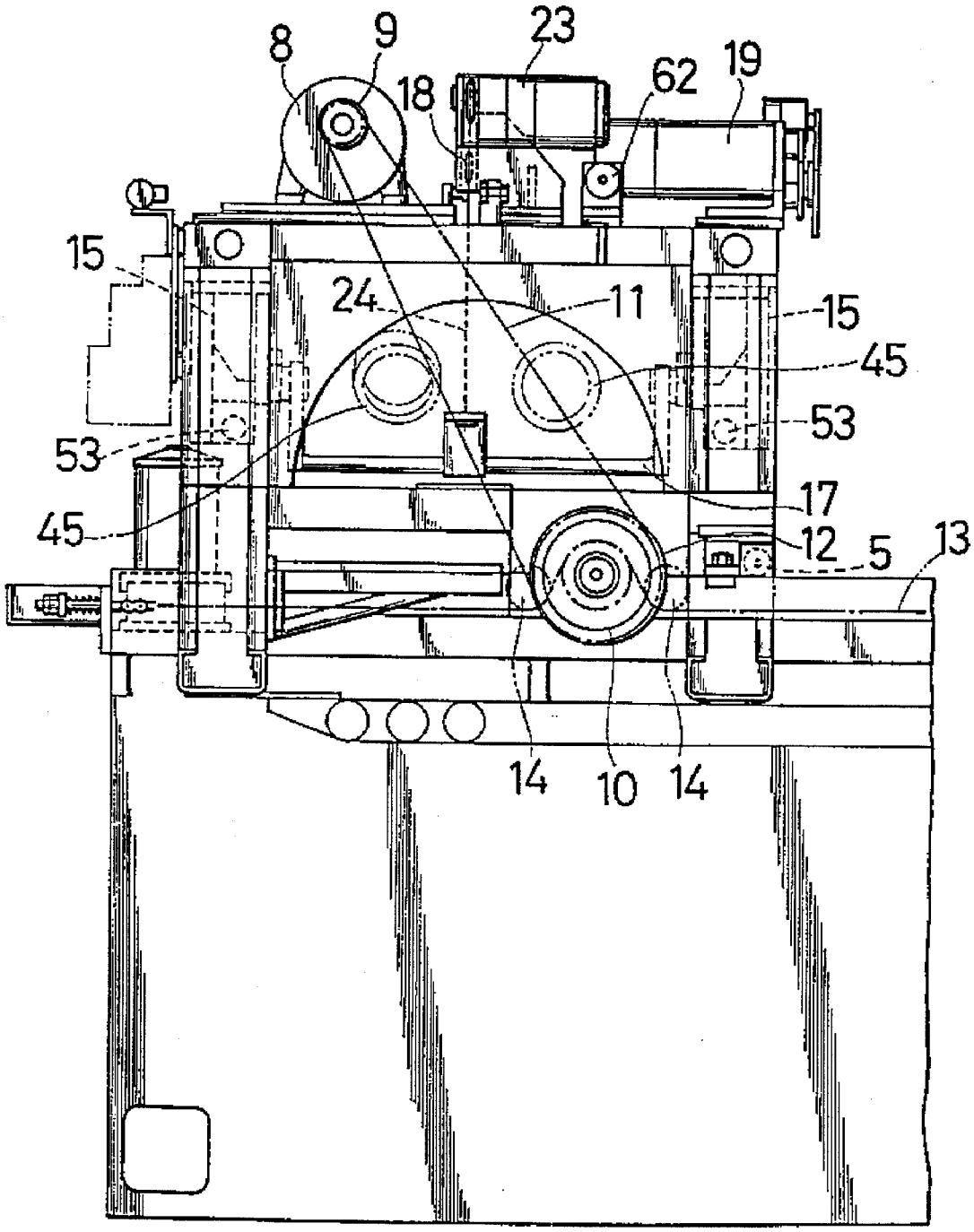
FIG. 4 is a rear view showing part of the grinding apparatus of FIG. 1.

As clearly seen in FIG. 3, in the grinding apparatus of the embodiment, an elongated cutting tool 2 to be ground is held on a table 3 to extend along a longitudinal axis of the table 3 and is pressed upright against an upright plate 1 by a plurality of fixing elements 4.

The table 3 has a length equal to or greater than the length of the cutting tool 2.

An inverse U-shaped carriage 6 with rollers 5 on the four corners thereof is mounted on the table 3 and is provided with a driving mechanism 7. The driving mechanism 7 for moving the carriage 6 includes a prime mover 8 mounted on the upper portion of the carriage 6, a belt 11 running between a pulley 9 of the prime mover 8 and another pulley 10 supported on one end of a rotary shaft to be disposed below the pulley 9, a chain pulley 12 attached on the other end of the rotary shaft to be connected to the pulley 10, and a chain 13 supported in tension on both longitudinal ends of the table 3 by means of a spring (not shown) to engage with the chain pulley 12. The driving mechanism 7 makes the carriage 6 movable along the longitudinal axis of the table 3.

A pair of support chain pulleys 14 mounted on both sides of and adjacent to the chain pulley 12 as shown in FIG. 4 are engaged with the chain 13 to prevent excessive vibration of the chain pulley 12.

The carriage 6 is provided with a pair of brackets 15, 15 projecting downward from a top element of the carriage 6 and disposed in parallel across the longitudinal axis of the table 3. A pair of base plates 16 and 17 facing to each other across the longitudinal axis of the table 3 are pivotably supported on between the pair of brackets 15,15 as clearly seen in FIGS. 2 and 3. A first face of the base plate 16 is opposed to a sloping surface 'a' of the cutting tool 2 uprightly supported to extend over the longitudinal axis of the table 3 whereas a second face of the base plate 17 is opposed to a non-sloping surface 'b' of the cutting tool 2. Here the second face is opposite to the first face across the longitudinal axis of the table 3. Angle setting units or angle adjusters 18,18 for varying the inclined angles of the base plates 16 and 17 are further mounted on the base plates 16 and 17, respectively.

A typical mechanism of the angle adjusters 18,18 attached to the base plates 16 and 17 is described briefly. A pinion gear 21 activated via a chain 20 by a prime mover 19 mounted on the carriage 6 engages with a fan-shaped rack gear 22 attached to one end of the base plate 16, so that the base plate 16 disposed on the side of the sloping surface 'a' of the cutting tool 2 is pivotably moved around the joint with the bracket 15. The base plate 17 disposed on the side of the non-sloping surface 'b' of the cutting tool 2 is connected to another prime mover 23 mounted on the carriage 6 via a chain 24 suspended on a gear of the prime mover 23.

Figure 5:
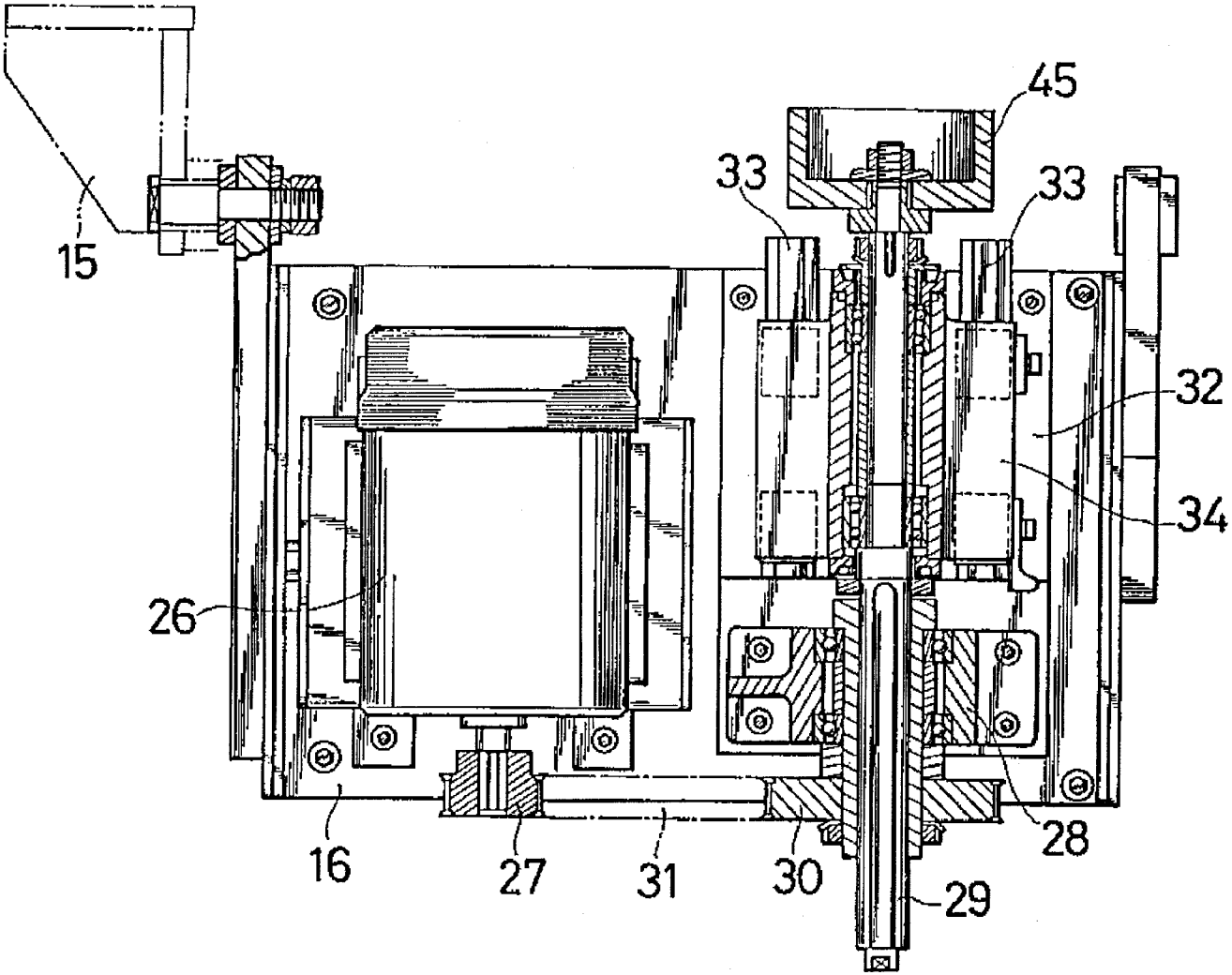
FIG. 5 is a partly broken plan view showing a primary part of the grinding apparatus of FIG. 2.

The pinion gear 21 and the prime mover 23 are respectively provided on a shaft thereof with rotational angle detection units or rotational angle detectors 25,25 each including an encoder and a linear transformer for detecting the inclined angles of the base plates 16 and 17 inclined corresponding to the pivotal movement thereof. Each base plate 16 or 17 is further provided with a prime mover 26 as typically shown in FIG. 5. A belt 31 runs between a pulley 27 of the prime mover 26 and another pulley 30 slidable with respect to a drive shaft 29 supported by means of a first bearing 28.

Substantially U-shaped guide plates 32,32 are further mounted on the base plates 16 and 17, respectively. A pair of sliding guides 33,33 including linear-ways are mounted on the diverged elements of each U-shaped guide plate 32 as clearly seen in FIGS. 5, 6, and 7. Although FIGS. 5, 6, and 7 only show the elements on the base plate 16, there is a similar structure on the base plate 17. A tubular sliding body 34 with the drive shaft 29 securely fitted therein is movably supported on the pair of sliding guides 33,33 by means of a pressing member 35.

Figure 6:
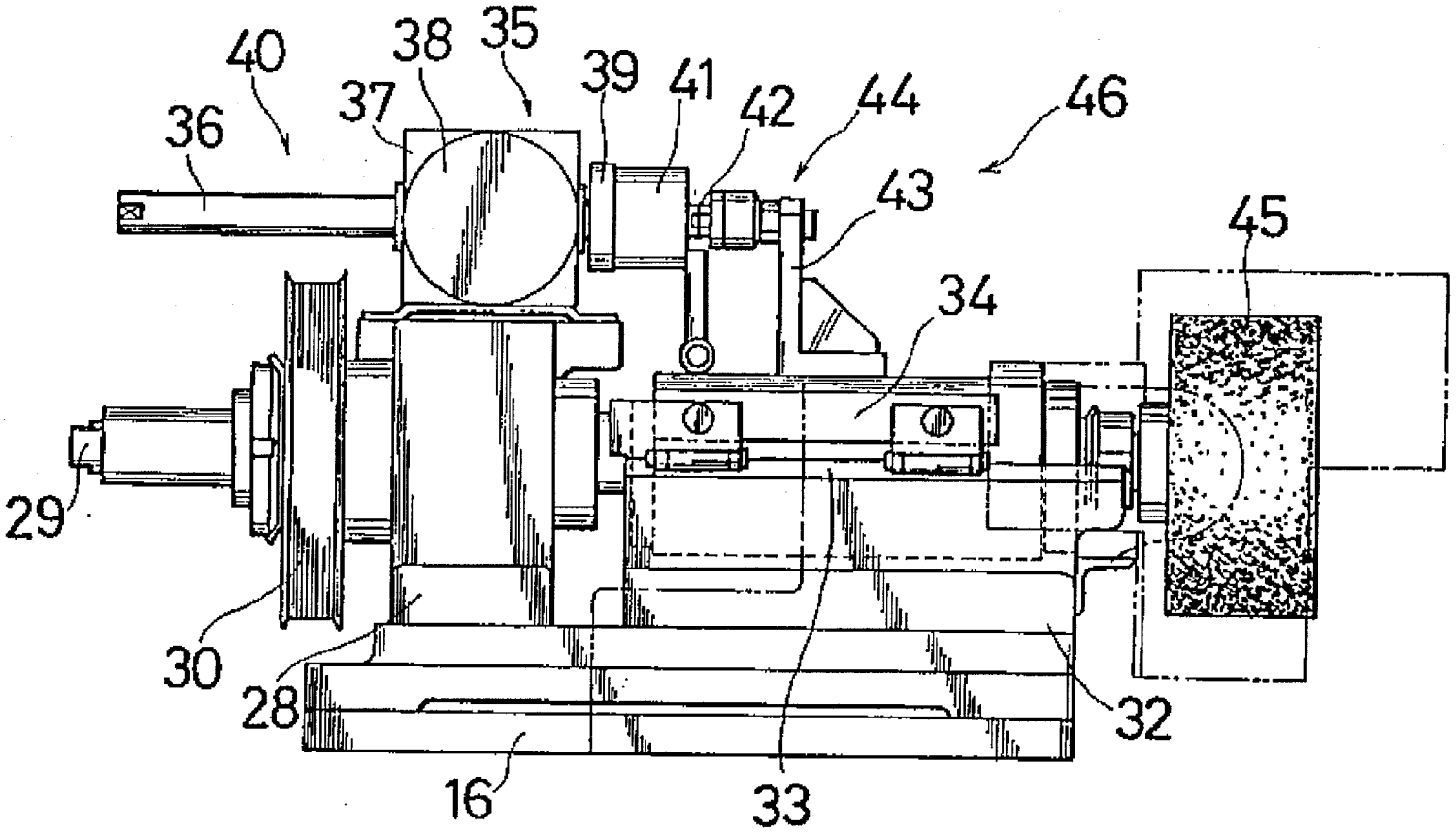
FIG. 6 is an enlarged side view showing the primary part of FIG. 5.

The pressing member 35 includes a transport unit 40 and a sliding unit 44 as shown in FIG. 6. The transport unit 40 includes a second bearing 37 disposed above the first bearing 28, a rack member 36 fitted in the second bearing 37, and a bracket 39 attached to the end of the rack member 36. The rack member 36 of the transport unit 40 is movable towards the cutting edge of the cutting tool 2 by means of a motor 38. In the sliding unit 44, a fluid cylinder 41 is attached to the upper end of the bracket 39, and a piston rod 42 of the fluid cylinder 41 is connected to a control plate 43 disposed above the sliding body 34.

A pair of grinding wheels 45,45 for grinding the sloping surface 'a' and the non-sloping surface 'b' of the cutting tool 2 are attached to the ends of the drive shafts 29 disposed on the base plates 16 and 17, respectively. A grinding depth of each grinding wheel 45 is set corresponding to a feeding amount of the transport unit 40. A grinding depth controller 46 for adjusting the grinding depth is activated by the motor 38 for driving the rack member 36 and stopped when it is confirmed by a proximity switch (not shown) that an indication of a dial indicator (not shown) reaches a preset amount 47 (see FIGS. 12 and 13). The preset amount 47 represents a maximum forward movement of the grinding wheel 45, that is, a maximum grinding depth. When the grinding depth reaches the preset amount 47 at each grinding step, grinding operation is immediately stopped. This prevents an uneven surface of the cutting tool 2 from being excessively ground by the grinding wheel 45 along the longitudinal axis of the cutting tool 2.

Figure 7:
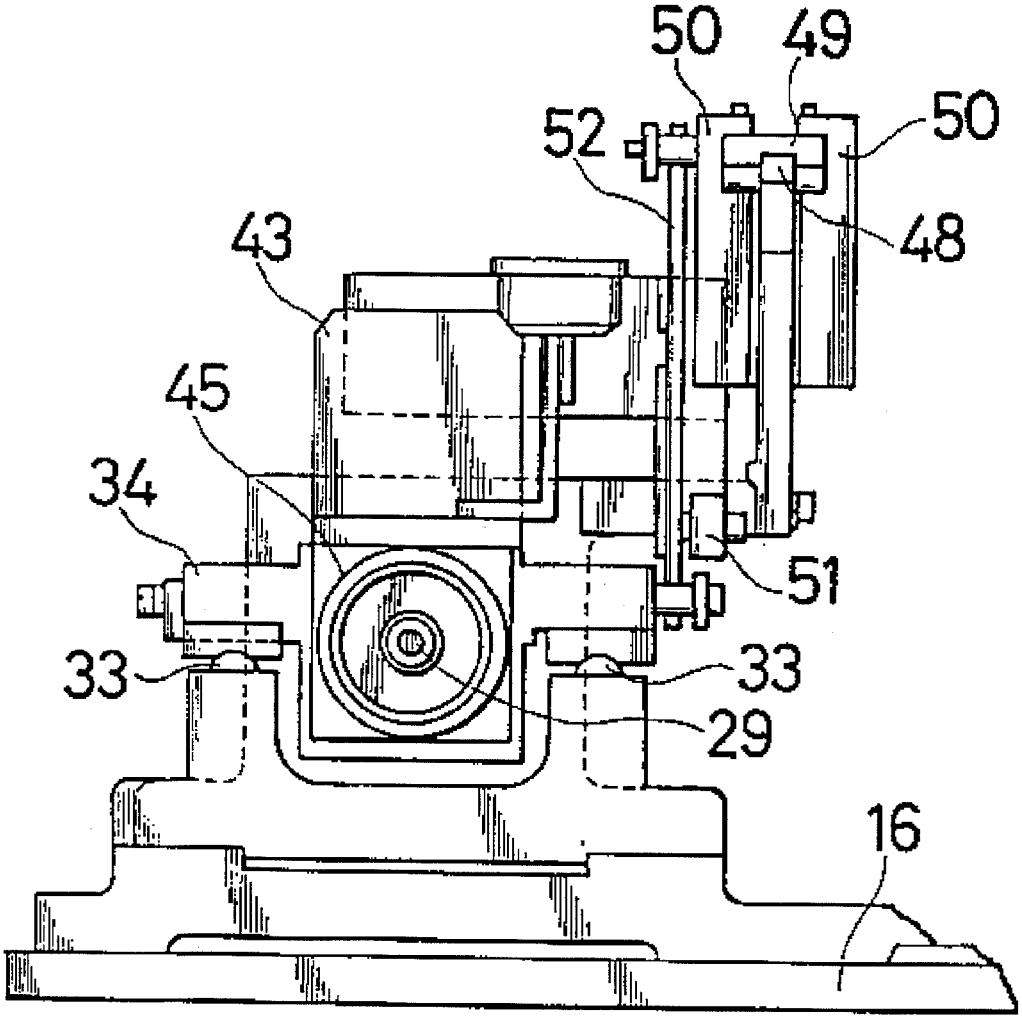
FIG. 7 is an enlarged front view showing the primary part of FIG. 5.

A rail member 48 is disposed above the base plate 16 or 17 parallel to a sliding direction of the drive shaft 29 as clearly shown in FIG. 7. A slide member 49 such as a roller or a linear way is attached onto the rail 48, and a balancer 50 is suspended from the rail 48 via the slide member 49. The sliding unit 44 and the balancer 50 are connected to each other by a link 52 with a fulcrum on one end of a link support 51 projected from the transport unit 40 towards the grinding wheel 45. The weight of the balancer 50 is determined according to the length of the link 52 from the fulcrum of the link support 51.

In the transport unit 40 on the base plate 16 or 17 slidingly movable relative to the cutting tool 2 and the sliding unit 44 supporting the grinding wheel 45 for grinding the cutting tool 2, the grinding depth is adjusted by making use of fluid pressure applied from the fluid cylinder 41 and the piston rod 42 connected thereto. Alternatively, a spring may be used for the same purpose.

In the embodiment, the grinding depth controller 46 is activated by the motor 38 for driving the rack member 36 and stopped when it is confirmed by a proximity switch (not shown) that an indication of a dial indicator (not shown) reaches the preset amount 47. An encoder or a linear transformer may be used in place of the dial indicator.

A pair of detectors 53 (see FIG. 4), each including a limit switch, a photo-electric tube, and a proximity switch, are attached to both ends of the base plates 16 and 17. A cooling water groove 54 (see FIG. 3) spans the whole moving distance of the grinding wheel 45 between the table 3 and the upright plate 1.

Figure 8:
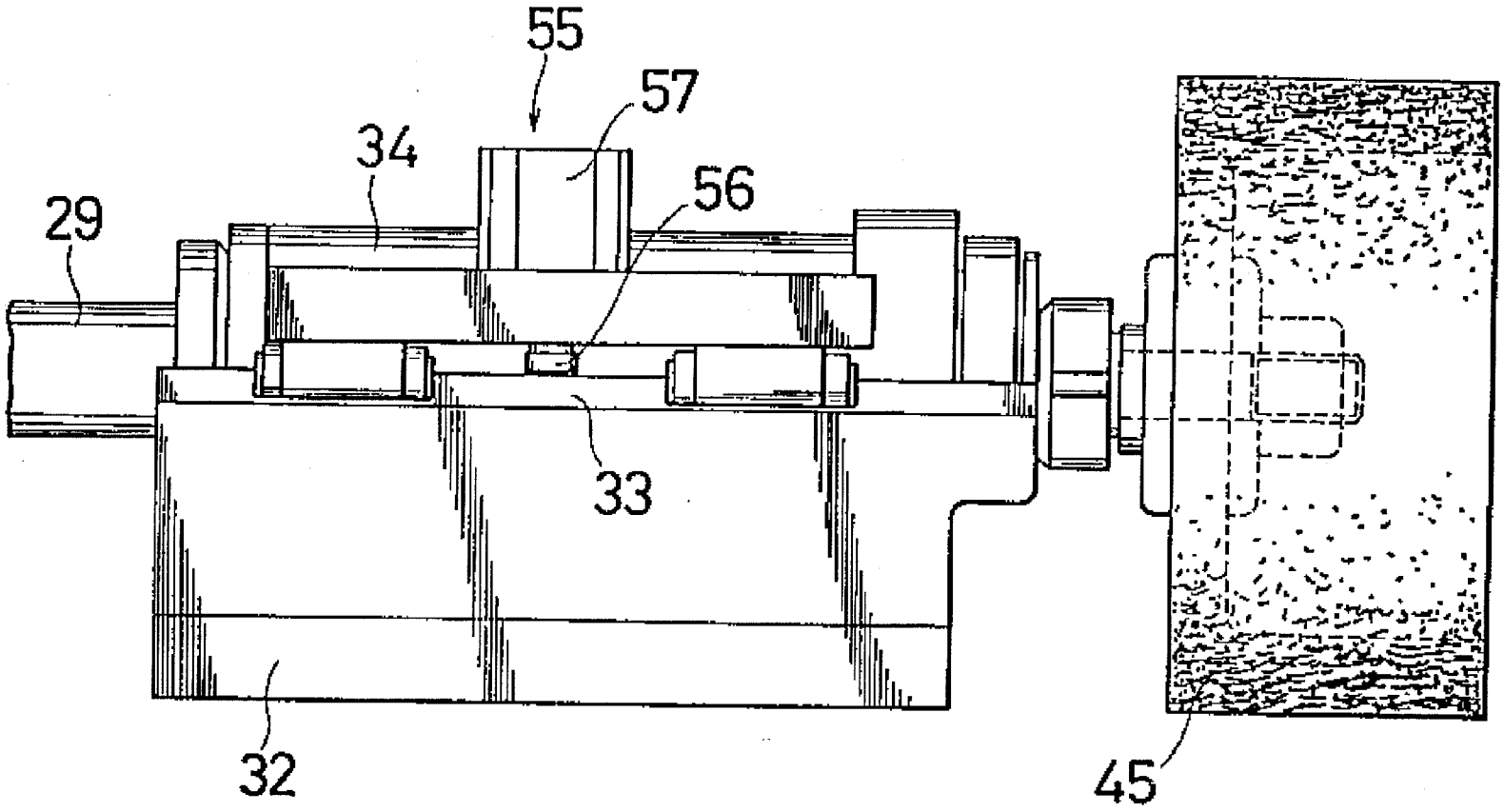
FIG. 8 is an enlarged side view illustrating a primary part of a braking mechanism.
Figure 9:
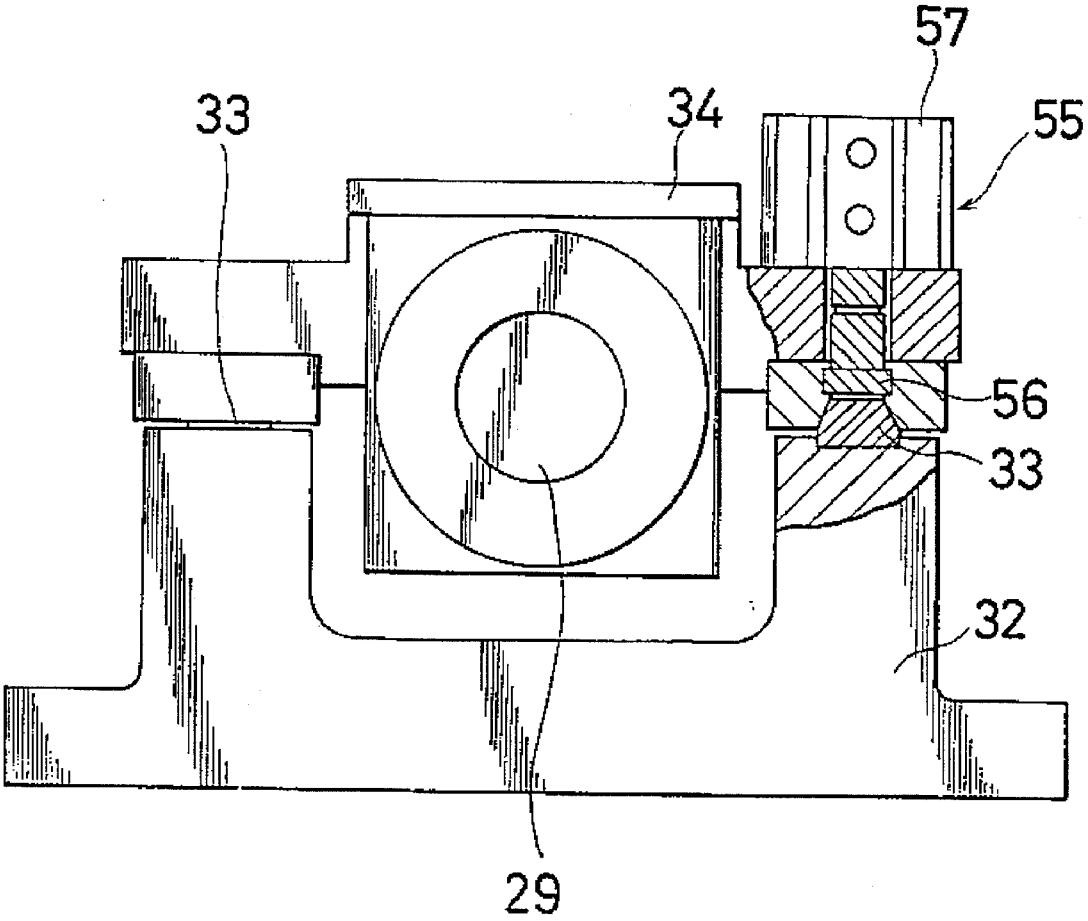
FIG. 9 is a partly omitted front view showing the braking mechanism of FIG. 8.

The sliding unit 44 is further provided with a braking mechanism 55 as shown in FIGS. 8 and 9. The braking mechanism 55 includes a piston rod 56 for pressing one of the sliding guides 33 disposed on both sides of the sliding body 34, and a cylinder 57 for actuating the piston rod 56 by making use of fluid pressure.

Although the fluid pressure cylinder is applied to the braking mechanism 55 in this embodiment, any other mechanism may be employed alternatively, for example, actuating a screw by a servo motor, or locking by means of a plunger corresponding to ON and OFF of an electromagnet. The number of the braking mechanism is also not limited.

FIGS. 10 through 15 are block diagrams showing typical examples of multiple-taper grinding the cutting edge of the cutting tool 2 from the tip portion to the base portion thereof to have an arc-shaped sloping surface 'a' and an arc-shaped non-sloping surface 'b'.

Figure 10:
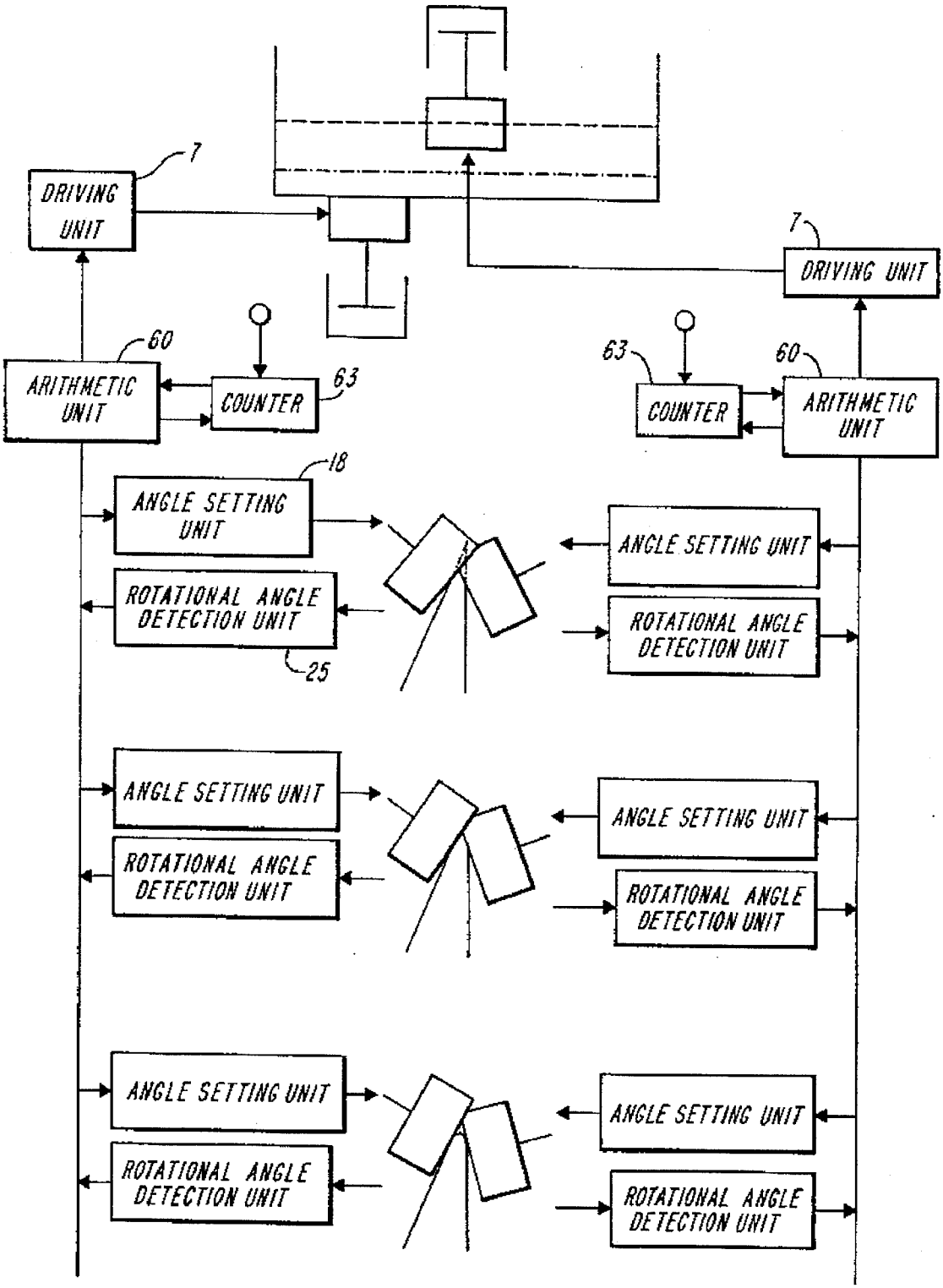
FIG. 10 is a block diagram showing an automatic control system with a counter.
Figure 11:
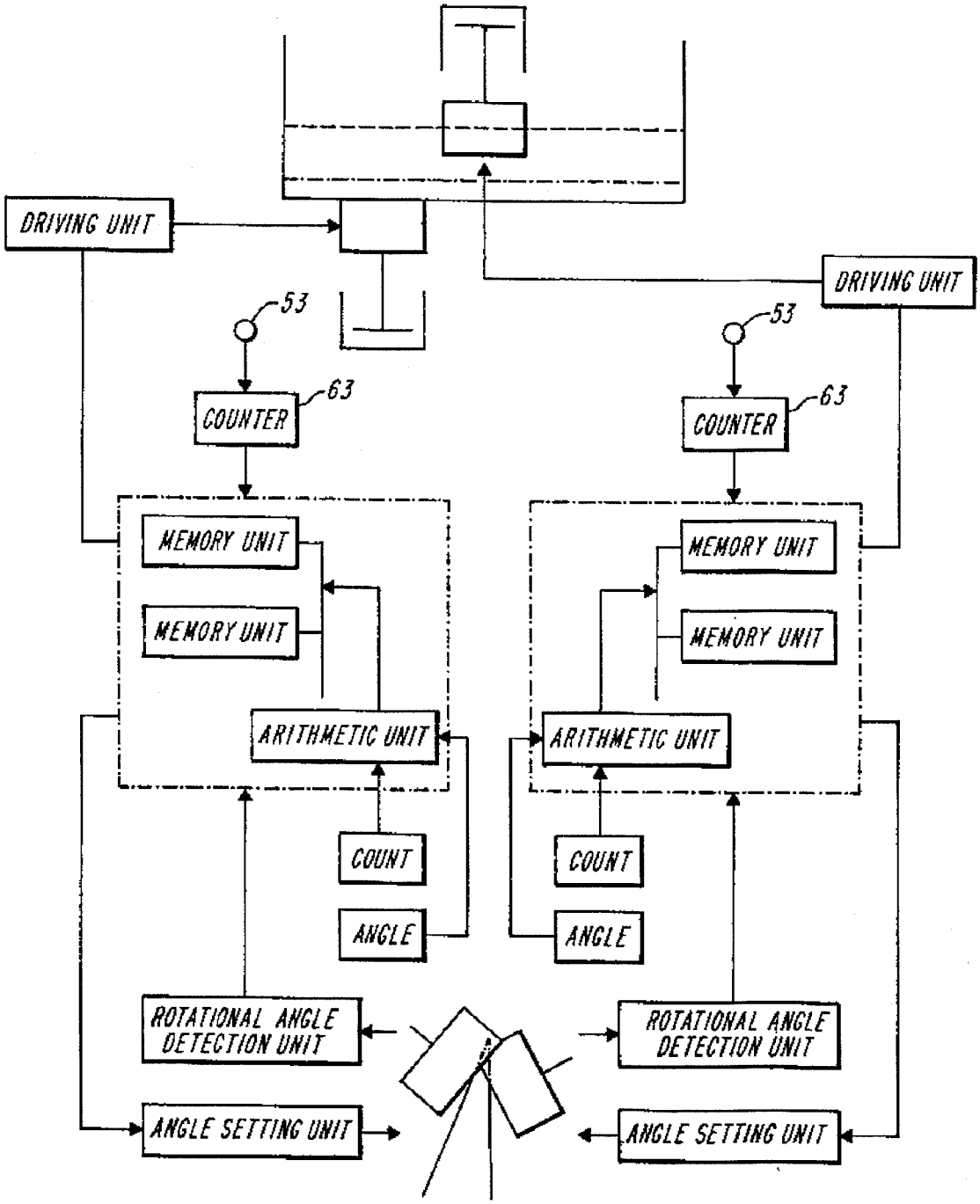
FIG. 11 is a block diagram showing a manual control system with a counter.
Figure 12:
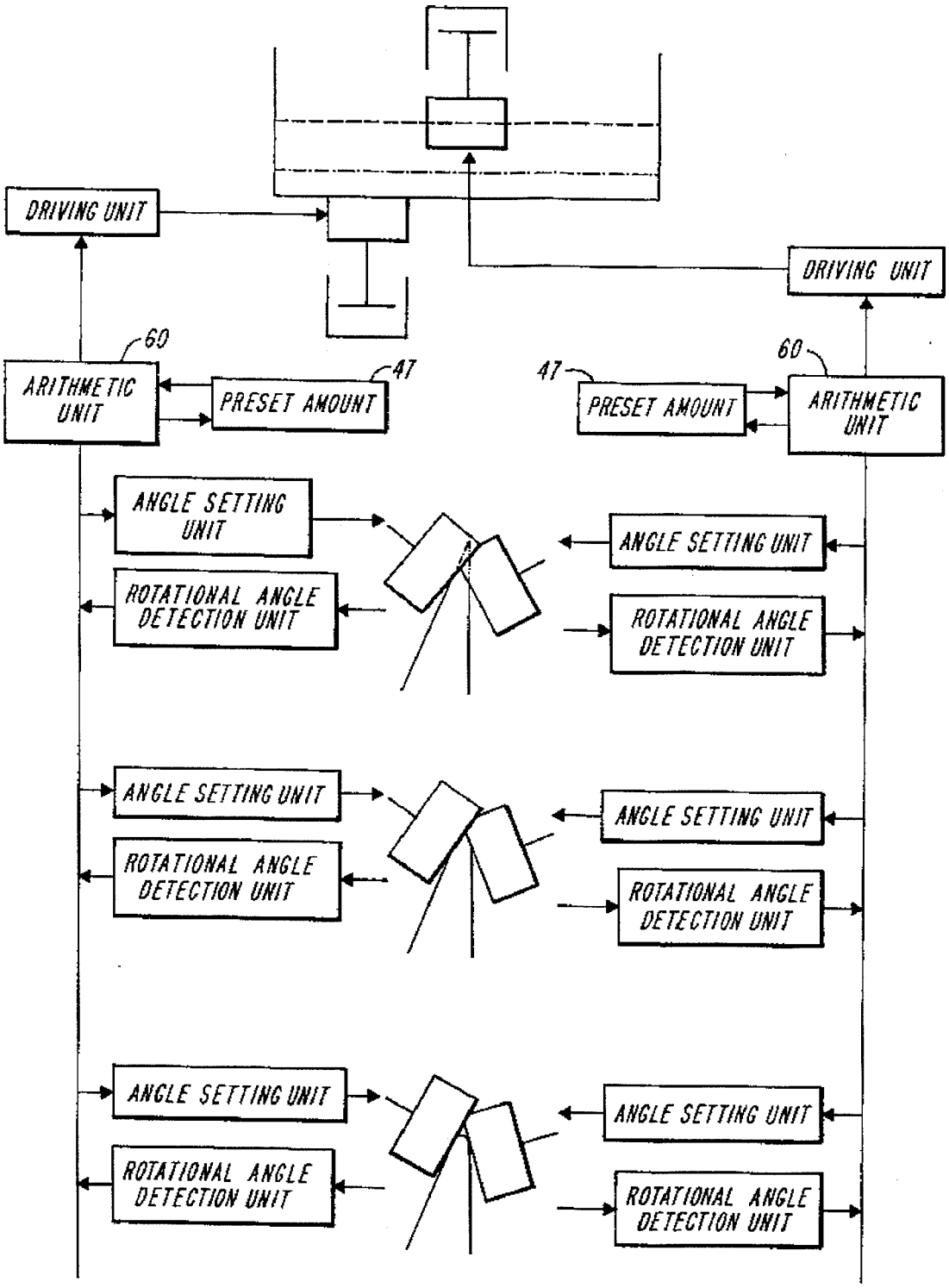
FIG. 12 is a block diagram showing an automatic control system based on a preset amount.
Figure 13:
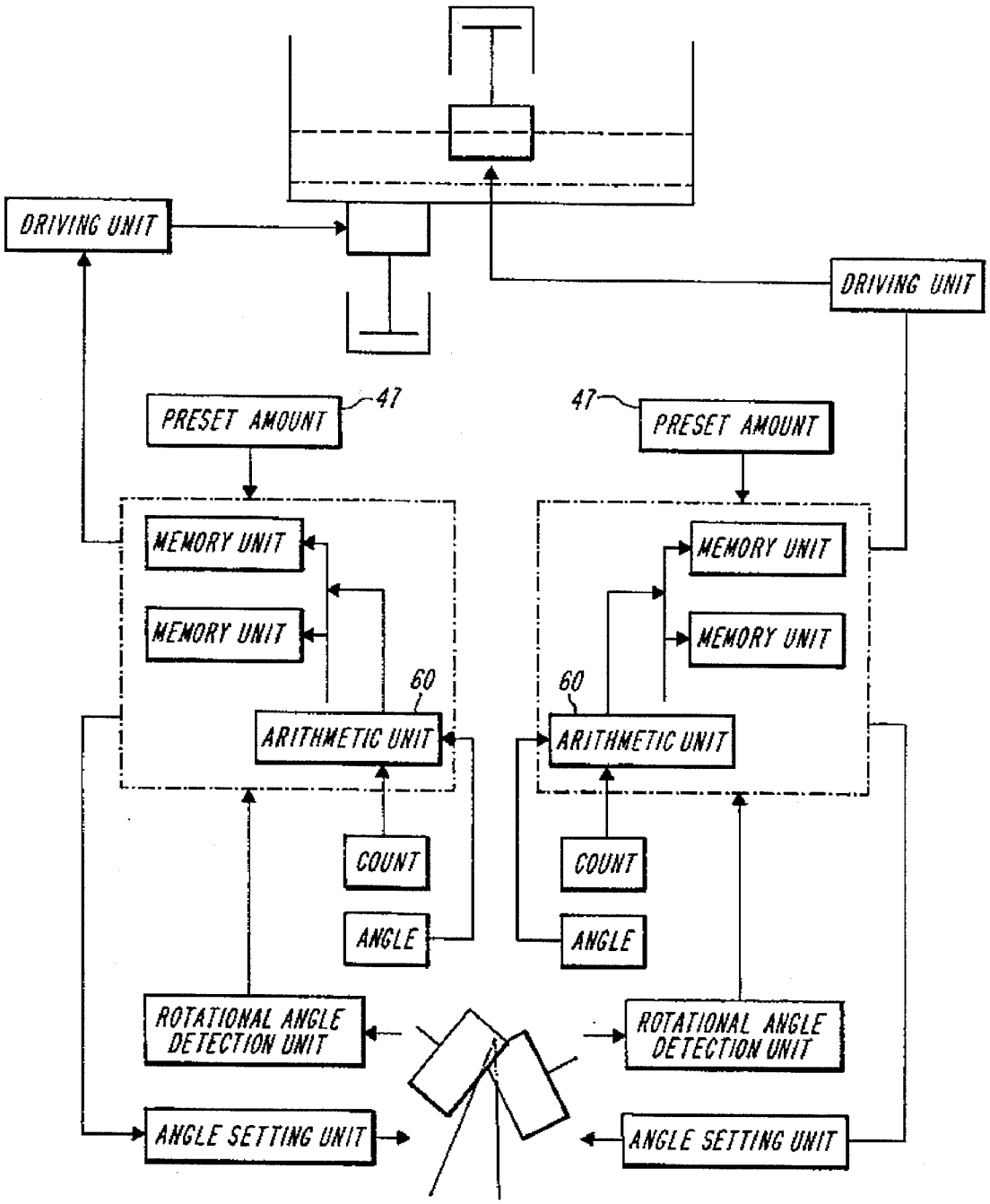
FIG. 13 is a block diagram showing a manual control system based on a preset amount.
Figure 14:
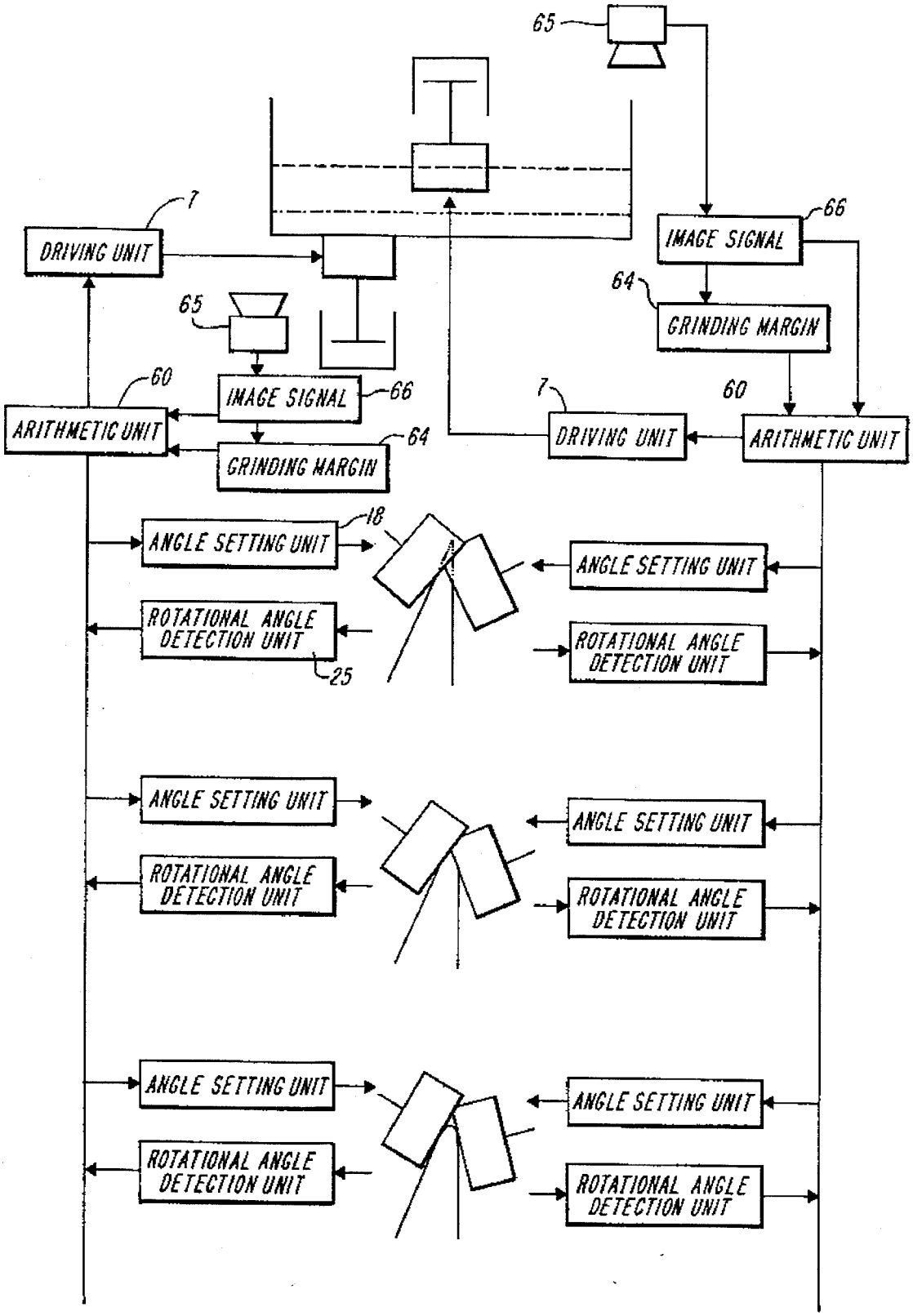
FIG. 14 is a block diagram showing an automatic control system based on an image signal.
Figure 15:
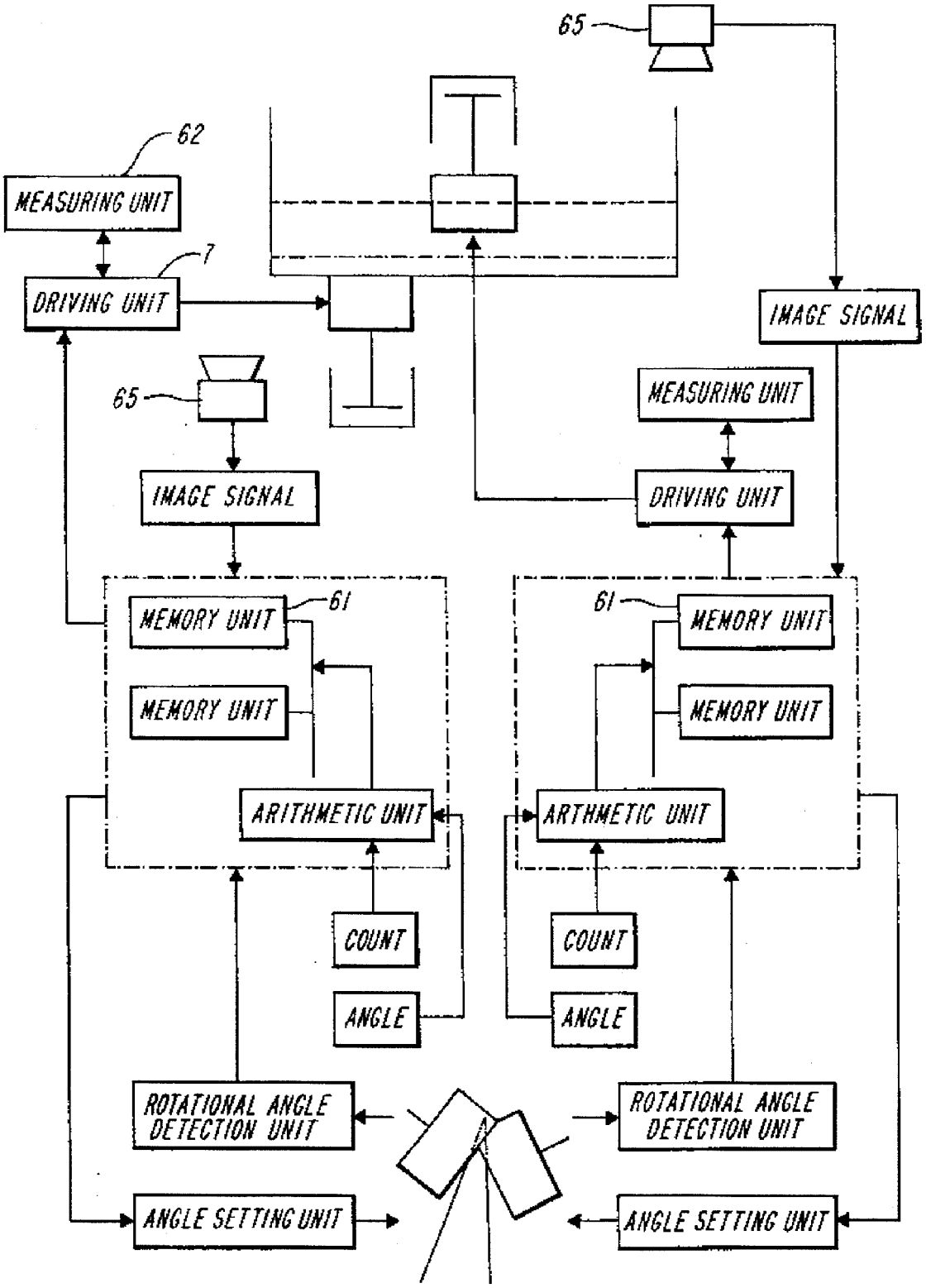
FIG. 15 is a block diagram showing a manual control system based on an image signal.

FIGS. 10, 12, and 14 show automatic control systems wherein grinding data including numbers of grinding steps and grinding depths and grinding angles corresponding to the respective grinding steps are previously stored in a pair of arithmetic units 60,60, one for the sloping surface 'a' and the other for the non-sloping surface 'b' of the cutting edge. A desirable grinding pattern is then selected out of the grinding data. On the other hand, FIGS. 11, 13, and 15 show manual control systems wherein a number of grinding steps and grinding angles and grinding depths at the respective grinding steps are input into a memory unit 61 prior to every grinding operation.

Grinding depths at each grinding angle are detected with one of the following three mechanisms.

In a first mechanism shown in FIGS. 10 and 11, the grinding depth is detected by the detector 53 as a number of reciprocating movement of the grinding wheel 45. The number of the reciprocating movement is then compared with a preset count in a counter 63.

In a second mechanism shown in FIGS. 12 and 13, a preset amount 47 in each dial indicator is determined by considering abrasion of the grinding wheel 45. An indication of the dial indicator detected as a grinding depth is then compared with the preset amount 47 by a proximity switch or a like element.

In a third mechanism shown in FIGS. 14 and 15, a process of grinding the cutting tool 2 is observed with a video camera 65. An image signal 66 from the video camera 65 is then compared with a predetermined grinding margin 64 of the cutting tool 2. In this mechanism, the driving mechanism 7 includes a time-measuring element (not shown) such as a timer for expressing a moving distance of the carriage 6 as a function of the time or a measuring element 62 (see FIG. 4) for detecting a moving distance and a position of the carriage 6.

In the above three mechanisms, after a grinding angle of the grinding wheel 45 set by the angle adjustor 18 is detected by the rotational angle detector 25, the driving mechanism 7 actuates the grinding wheel 45 to reciprocate along the longitudinal axis of the cutting tool 2. When the number of reciprocating movement reaches the preset count in the counter 63, when the indication in the dial indicator reaches the preset amount 47, or when the image signal 66 from the video camera 65 reaches the grinding margin 64, the arithmetic unit 60 stops the driving mechanism 7 and thereby the grinding wheel 45 and actuates the angle adjustor 18 to prepare for grinding at a next step.

The apparatus for grinding the cutting edge thus constructed is operated in the following manner.

The cutting tool 2 which has roughly been ground with a knife grinder is vertically laid on the table 3 and pressed by the fixing elements 4 to face the cutting edge thereof upward. An automatic or manual control system is then selected. When data for a certain wood material has empirically been obtained, the manual control system is applied to select a desirable grinding pattern out of the stored data including grinding angles and grinding depths at each step of multiple-taper grinding. On the contrary, when there is no data obtained for a wood material, the manual control system is applied to find the desirable grinding angle and grinding depth by trial and error.

A number of grinding steps and grinding angles and grinding depths at the respective grinding steps are determined for the sloping surface 'a' and the non-sloping surface 'b' of the cutting edge.

Figure 16:
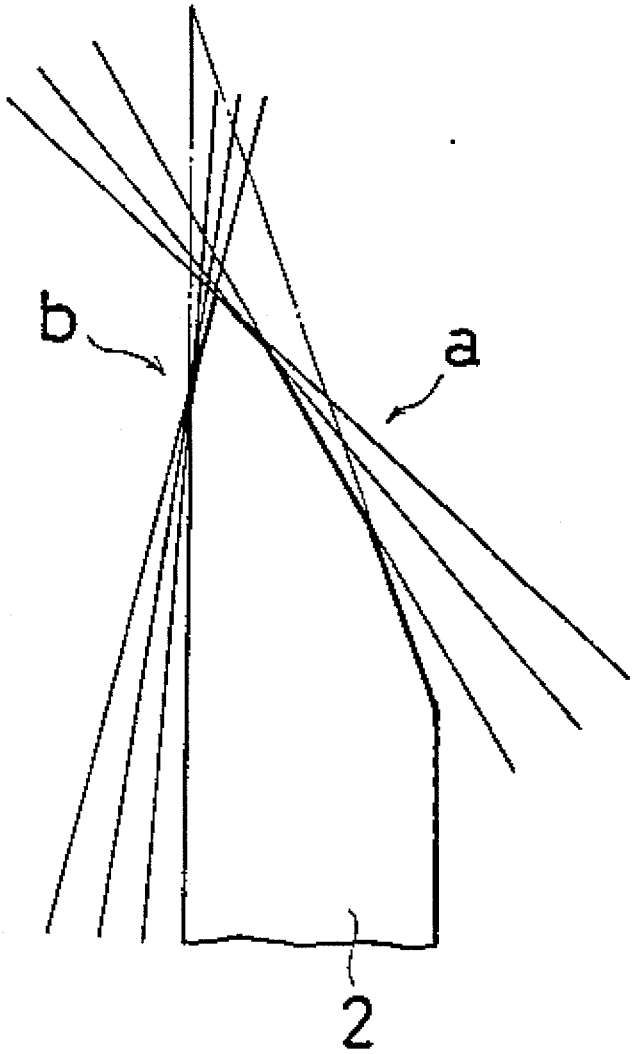
FIG. 16 is a schematic view showing a cutting edge of an elongated cutting tool ground according to the method of the invention.
Figure 17:
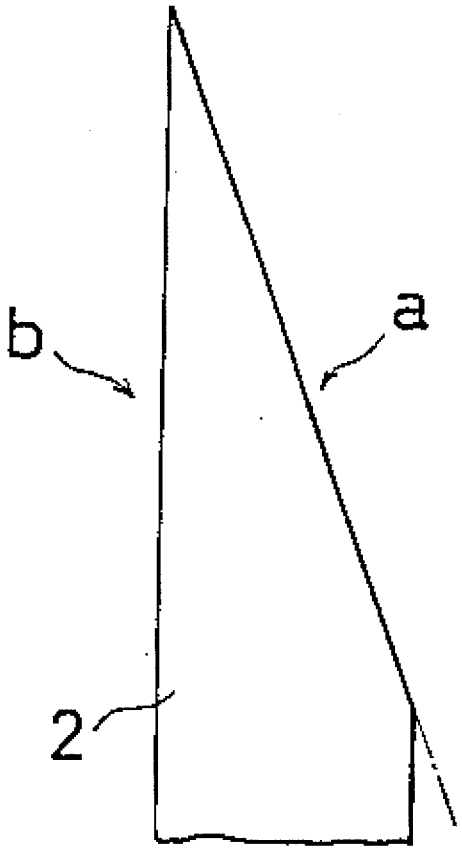
FIG. 17 PRIOR ART
FIG. 17 is a schematic view showing a cutting edge of an elongated cutting tool ground according to a conventional method.

In one example shown in FIG. 16, both the sloping surface 'a' and the non-sloping surface 'b' are finished by triple-taper grinding. The grinding angle and the grinding depth for the sloping surface 'a' are set equal to 30 degrees and $^{5}/_{100}$ through $^{8}/_{100}$ mm (corresponding to the count 14 in the counter 63) at a first grinding step, 26 degrees and $^{10}/_{100}$ through $^{15}/_{100}$ mm (corresponding to the count 2 in the counter 63) at a second grinding step, and 23.30 degrees and $^{20}/_{100}$ through $^{30}/_{100}$ mm (corresponding to the count 2 in the counter 63) at a third grinding step.

The grinding angle and the grinding depth for the non-sloping surface 'b' are set equal to 10 degrees and $^{10}/_{100}$ mm (corresponding to the count 12 in the counter 63) at a first grinding step, 5 degrees and $^{20}/_{100}$ mm (corresponding to the count 2 in the counter 63) at a second grinding step, and 0.10 degrees and $^{20}/_{100}$ mm (corresponding to the count 2 in the counter 63) at a third grinding step.

In the above example, the count at the second or third grinding step is significantly smaller than the same at the first grinding step. This is attributable to a greater grinding depth at the first grinding step as clearly seen in FIG. 16.

After the suitable control system is selected, the grinding angles of the pair of grinding wheels 45,45 for grinding the sloping surface 'a' and the non-sloping surface 'b' of the cutting edge of the cutting tool 2 are set by actuating the prime movers 19 and 28 based on signals sent from the angle adjusters 18,18 and then checked by the rotational angle detectors 25,25.

An initial grinding depth for the cutting edge is determined by the grinding depth controller 46. The prime mover 8 is driven to activate the carriage 6 to move the pair of grinding wheels 45,45 to the sloping surface 'a' and the non-sloping surface 'b' of the cutting edge of the cutting tool 2. When the carriage 8 reaches the cutting tool 2, the fluid cylinder 41 is actuated to supply fluid from each port thereof to make the pressure in a rear cylinder chamber of the cylinder 41 higher than that of a front cylinder chamber thereof and stretch the piston rod 42. Accordingly, the rack member 36 is moved towards the cutting edge by the motor 38 while the control plate 48 is pressed forward.

When the rack member 36 is moved forward along the bearing 37, the piston rod 42 of the fluid cylinder 41 attached to the bracket 39 slides the sliding body 34 with the drive shaft 29 fitted therein in the axial direction via the control plate 43 to bring each grinding wheel 45 in contact with each surface of the cutting edge of the cutting tool 2. Although a backward moment is applied to the drive shaft 29, each grinding wheel 45 remains in contact with the cutting edge because of a forward pressure of the piston rod 42 of the fluid cylinder 41 against the drive shaft 29. The magnitude of the fluid pressure applied to the drive shaft 29 is determined by adding an expected degree of unevenness in rough grind to the grinding depth for a ricasso or a base portion of the cutting tool 2 with respect to the cutting edge. The amount of the backward movement of the drive shaft 29 against the fluid pressure thereby represents a maximum grinding depth required for the ricasso or the base portion of the cutting tool 2.

The base plate 16 or 17 is inclined by a predetermined angle set by the angle adjustor 18, and the dead weights of each grinding wheel 45 and the sliding unit 44 are about to move the sliding unit 44. The balancer 50 on the rail member 48 projected from the base plate 16 or 17 moves along the rail member 48 in a direction to balance the dead weights thereof with the fulcrum on the link support 51, thus allowing stable and constant grind.

The fluid is released from the rear cylinder chamber of the fluid cylinder 41 so as to contract the piston rod 42 and actuate the driving mechanism 7 to move the carriage 6 back to its original waiting position. The prime mover 26 is then actuated to apply a rotational force to each grinding wheel 45.

The chain pulley 12 starts rotation with actuation of the driving mechanism 7. Since the chain pulley 12 is supported by the support chain pulleys 14 mounted on both sides of the chain pulley 12 to increase a running force applied onto the chain 13, the carriage 6 smoothly moves and each grinding wheel 45 favorably starts grind of the cutting tool 2. The pair of detectors 53,53 disposed on either side of the carriage 6 detect the position of the carriage 6 with respect to the cutting tool 2.

When the carriage 6 is activated to move from a first end in a first direction along the longitudinal axis of the cutting tool 2, fluid is supplied into the rear cylinder chamber of the fluid cylinder 41 to stretch the piston rod 42. Each grinding wheel 45 is accordingly pressed against the cutting edge of the cutting tool 2 to start grinding. When the detector 53 detects that the carriage 6 reaches a second end of the cutting tool 2, the cylinder 57 of the braking mechanism 55 is synchronously activated to press the piston rod 56 against the sliding guides 33 and lock the sliding movement of the sliding body 34.

After the carriage 6 continues moving in the first direction to pass by the second end of the cutting tool 2 under the above locking condition, the prime mover 8 is inversely driven to return the carriage 6 to the second end of the cutting tool 2. When the measuring element 62 detects the return of the carriage 6, the lock of the braking mechanism 55 is released to move the carriage 6 in a second direction, that is, from the second end to the first end. The above reciprocating movement in the first direction and the second direction is repeated by a predetermined number of times.

In a modified system without the braking mechanism 55, the grinding wheel 45 is separated from the cutting edge of the cutting tool 2 by stopping fluid supply into the rear chamber of the fluid cylinder 41 or driving the motor 38 to inversely move the rack member 36 and is brought into contact with the cutting edge by re-starting fluid supply or moving the rack member 36 in the normal direction.

When grinding at the initial grinding angle is completed, the driving mechanism 7 is stopped and the braking mechanism 55 is released. Implementation of the first grinding step is determined based on the count in the counter 63, the preset amount 47, or the image signal 66 from the video camera 65 as described above. The angle adjustors 18 are then activated to set second grinding angles at a second grinding step for the sloping surface 'a' and the non-sloping surface 'b' of the cutting edge. Each angle adjustor 18 is driven directly in the automatic control system or via the memory unit 61 in the manual control system. After the second grinding angle is set by actuating the prime mover 19 or 23 and checked by the rotational angle detector 25, the driving mechanism 7 is driven again to start grinding at the second grinding angle. Each time when the grinding angle is changed, the balancer 50 slides on the rail member 48 via the slide member 49 to balance the dead weights of the grinding wheel 45 and the sliding unit 44, thus preventing an excessive weight from being applied onto the cutting edge of the cutting tool 2.

The above procedure is repeated for a predetermined number of grinding steps to complete multiple-taper grinding of the cutting edge from a tip portion to a base portion thereof to give a first arc-like shape to the sloping surface 'a' and a second arc-like shape to the non-sloping surface 'b' as shown in FIG. 16. Although the grinding depth decreases from the tip portion to the base portion of the cutting edge in the embodiment, it may alternatively increase from the base portion to the tip portion.

As described above, the cutting edge of the elongated cutting tool of the embodiment has a first surface and a second surface, which are multiple-taper ground from a tip portion to a base portion thereof to have an arc shape, respectively. This gives a sufficient thickness to the cutting edge of the cutting tool, which prevents excessive vibration of the cutting edge and reduces damage or crack of a rear face of a veneer cut from a log, thereby allowing stable and constant cutting of veneers from a log.

The apparatus of the embodiment allows relatively easy multiple-taper grinding with a control mechanism for controlling a moving distance and an inclined angle of each grinding wheel according to a preset number of grinding steps and a predetermined grinding depth and a predetermined grinding angle at each grinding step for each surface of the cutting edge.

Since there may be many other modifications, alternations, and changes without departing from the scope of the invention, it is clearly understood that the above embodiments are only illustrative and not restrictive in any sense.

What is claimed is:

1. An apparatus for grinding an elongated cutting tool comprising a table for supporting thereon said cutting tool extending along a longitudinal axis of said table, a fixing element for pressing said cutting tool upright against an upright plate to face a cutting edge of said cutting tool upward, a carriage reciprocatingly movable along the longitudinal axis of said table, and a driving mechanism for driving said carriage to move along said longitudinal axis, said apparatus further comprising a first grinding wheel attached to said carriage to be movable into and out of endwise grinding contact with a first surface of said cutting edge of said upright cutting tool at a predetermined angle, a second grinding wheel attached to said carriage to be movable into and out of endwise grinding contact with a second surface of said cutting edge of said upright cutting tool at a predetermined angle, and a control mechanism for adjusting a moving distance and an inclined angle of each grinding wheel according to a preset number of grinding steps and a predetermined grinding depth and a predetermined grinding angle at each grinding step for each surface of said cutting edge.

2. An apparatus in accordance with claim 1, wherein said control mechanism comprises arithmetic means for storing a variety of data including preset numbers of grinding steps and predetermined grinding depths and predetermined grinding angles at respective grinding steps for said first surface and said second surface of said cutting edge, and automatic control means for automatically selecting a desirable grinding pattern out of said variety of data stored in said arithmetic means.

3. An apparatus in accordance with claim 2, wherein said automatic control means further comprises counter means for counting a number of reciprocating movement of each of said first grinding wheel and said second grinding wheel, first comparison means for comparing said number of reciprocating movement of said first grinding wheel and said second grinding wheel with a predetermined number, and first regulation means for stopping said driving mechanism when said number of reciprocating movement reaches said predetermined number.

4. An apparatus in accordance with claim 2, wherein said automatic control means further comprises indicating means for indicating a grinding depth of each of said first grinding wheel and said second grinding wheel, second comparison means for comparing said grinding depth of said first grinding wheel and said second grinding wheel with a preset amount, and second regulation means for stopping said driving mechanism when said grinding depth reaches said preset amount.

5. An apparatus in accordance with claim 2, wherein said automatic control means further comprises observation means for observing a grinding depth of each of said first grinding wheel and said second grinding wheel and outputting an image signal corresponding to said grinding depth, third comparison means for comparing said image signal with a predetermined grinding margin, and third regulation means for stopping said driving mechanism when said image signal becomes equal to said grinding margin.

6. A method of multiple-taper grinding a first surface and a second surface of a cutting edge of an elongated cutting tool with a pair of grinding wheels mounted on a carriage movable along a longitudinal axis of a table for supporting thereon said cutting tool extending along the longitudinal axis thereof, said method comprising the steps of (a) multiple-taper grinding said first surface of said cutting edge based on predetermined grinding angles and predetermined grinding depths at a plurality of grinding steps set by a control mechanism, and (b) multiple-taper grinding said second surface of said cutting edge based on predetermined grinding angles and predetermined grinding depths at a plurality of grinding steps set by a control mechanism.

* * * * *